US011112066B2

(12) United States Patent
Moon

(10) Patent No.: US 11,112,066 B2
(45) Date of Patent: Sep. 7, 2021

(54) LASER LIGHT INSTALLED INSIDE CAVITY OF BULB LAMP AND METHOD OF ASSEMBLING LASER LIGHT INSIDE CAVITY OF BULB LAMP

(71) Applicant: Sang Pil Moon, Seoul (KR)

(72) Inventor: Sang Pil Moon, Seoul (KR)

( * ) Notice: Subject to any disclaimer, the term of this patent is extended or adjusted under 35 U.S.C. 154(b) by 0 days.

(21) Appl. No.: 17/071,065

(22) Filed: Oct. 15, 2020

(65) Prior Publication Data

US 2021/0025551 A1 Jan. 28, 2021

Related U.S. Application Data

(63) Continuation of application No. PCT/CN2018/083196, filed on Apr. 16, 2018.

(51) Int. Cl.

| | |
|---|---|
| ***F21V 17/10*** | (2006.01) |
| ***F21V 19/00*** | (2006.01) |
| ***F21K 9/237*** | (2016.01) |
| ***F21V 29/70*** | (2015.01) |
| ***F21K 9/69*** | (2016.01) |
| ***F21K 9/90*** | (2016.01) |
| *F21Y 115/10* | (2016.01) |

(52) U.S. Cl.
CPC ..... *F21K 9/237* (2016.08); *F21K 9/69* (2016.08); *F21K 9/90* (2013.01); *F21V 29/70* (2015.01); *F21Y 2115/10* (2016.08)

(58) Field of Classification Search
CPC ..... F21K 9/237; F21K 9/90; F21Y 2115/30
See application file for complete search history.

(56) References Cited

U.S. PATENT DOCUMENTS

2015/0109680 A1* 4/2015 Vorndran ..... H01S 5/02208 359/641
2016/0084451 A1* 3/2016 Annen ..... F21V 13/14 362/553

FOREIGN PATENT DOCUMENTS

| | | | |
|---|---|---|---|
| CN | 202901893 | U | 4/2013 |
| CN | 107270146 | A | 10/2017 |
| CN | 207065178 | U | 3/2018 |

OTHER PUBLICATIONS

International Search Report of PCT Patent Application No. PCT/CN2018/083196 dated Jan. 22, 2019.

* cited by examiner

*Primary Examiner* — Karabi Guharay

(57) ABSTRACT

The invention provides a laser light installed inside a bulb lamp and a method of assembling a laser light inside a bulb lamp. The laser light comprises a bulb lamp, wherein a fixing support which further has heat dissipation function is coaxially arranged on an LED light board disposed inside the bulb lamp, a laser module is sleeved inside the fixing support. The laser module consists of a lens module, a laser head base, a laser head and a heat dissipating tube. The lens module consists of a focus base, and further, a transparent piece, a grating piece, a lens base, a lens and a lens fixing base accommodated in the lens base, which are sleeved inside the focus base in sequence. A through hole is provided on a portion of a lamp cover corresponding to the laser module and is enclosed by a transparent cap.

3 Claims, 3 Drawing Sheets

LASER LIGHT INSTALLED INSIDE CAVITY OF BULB LAMP AND METHOD OF ASSEMBLING LASER LIGHT INSIDE CAVITY OF BULB LAMP

CROSS REFERENCE TO RELATED APPLICATIONS

The present application is a Continuation Application of PCT Application No. PCT/CN2018/083196 filed on Apr. 16, 2018, the contents of which are incorporated herein by reference in their entirety.

TECHNICAL FIELD

The invention relates to lamps, more particularly to a laser light installed inside a cavity of a bulb lamp and a method of assembling a laser light inside a cavity of a bulb lamp.

BACKGROUND

Chinese patent No. 201220416607.4 discloses a laser light bulb. It aims to provide a laser light bulb which has entertainment function and is applicable to entertainment places. To realize such objective, the utility model provides the following technical solution. The laser light bulb comprises a lamp housing, a lamp base and a translucent cover, wherein the lamp housing and the translucent cover define an accommodation cavity, in which a laser emitter is arranged. Herein, a grating piece or a patterned plate is arranged between the laser beam emitting end of the laser emitter and the translucent cover. A motor arranged inside the lamp housing has a rotation shaft associated with the grating piece or the patterned plate synchronously. It has a disadvantage in that, it can only emit single laser beam for entertainment rather than for illumination. It has only one function and cannot be used widely.

SUMMARY

Technical Problem

One object of the invention is to provide a dual purpose laser light adapted for mounting in a conventional bulb lamp. By means of a switch, the laser light can be switched between a function of a conventional lamp and a function of a laser light by a consumer according to the needs of different applications. Another object of the invention is to provide a method of assembling a laser light inside a cavity of a bulb lamp, wherein the laser light installed inside a conventional bulb lamp has dual functions and can be switched, by means of a switch, between a function of a conventional lamp and a function of a laser light by a consumer according to the needs of different applications.

Technical Solution

The invention provides a technical solution of a laser light installed inside a cavity of a bulb lamp, which comprises a bulb lamp, wherein a fixing support which further has heat dissipation function is coaxially arranged on an LED light board disposed inside the cavity of the bulb lamp, a laser module is sleeved inside the fixing support, a through hole is provided on a portion of a lamp cover corresponding to the laser module, and the through hole is enclosed by a transparent cap.

Preferably, the fixing support mainly consists of a small conical part, a big conical part extending from a bottom of the small conical part, a pair of support legs symmetrically extending from a bottom of the big conical part, ear shaped parts respectively extending radially outwards from ends of support legs, and screw holes respectively provided on the ear shaped parts.

Preferably, the laser module mainly consists of a lens module, a laser head base, a heat dissipating tube, and a laser head disposed inside the laser head base.

Preferably, the lens module mainly consists of a focus base, and further, a transparent piece, a grating piece and a lens base which are sleeved inside the focus base in sequence, and further a lens and a lens fixing base which are accommodated in the lens base.

The invention provides another technical solution of a method of assembling a laser light inside a cavity of a bulb lamp, which comprises the following steps.

(1) Inserting a transparent piece, a grating piece, a lens base, a lens, a lens fixing base in sequence into a focus base. Meanwhile, assembling these components in an integrated manner into a lens module by means of a fastener of the lens fixing base.

(2) Inserting a laser head into a laser head base, connecting the laser head with the lens module in a threaded connection manner by engaging male threads of the focus base with female threads of the laser head base, and then engaging a heat dissipating tube with a bottom of the laser head base, whereby a laser module is assembled.

(3) Inserting the assembled laser module into a fixing support, connecting the laser module with a PCB board by a wire, mounting the fixing support at an opening of an LED light board, and guiding screws through screw holes of ear shaped parts of the fixing support and screw holes of the LED light board to fixedly connect the fixing support with the LED light board.

(4) Ultrasonic fixing a transparent cap with a lamp cover, and finally fastening the lamp cover to a lamp holder to complete the installation.

Advantages (1) It saves material by achieving functions of two types of lamps with the material for producing one lamp.

(2) The dual purpose light can be switched, by means of a switch, between a function of a conventional lamp and a function of a laser light by a consumer according to the needs of different applications.

(3) It has a wide range of application and can be widely used in bulb lamps and LED lamps.

Figure 1:
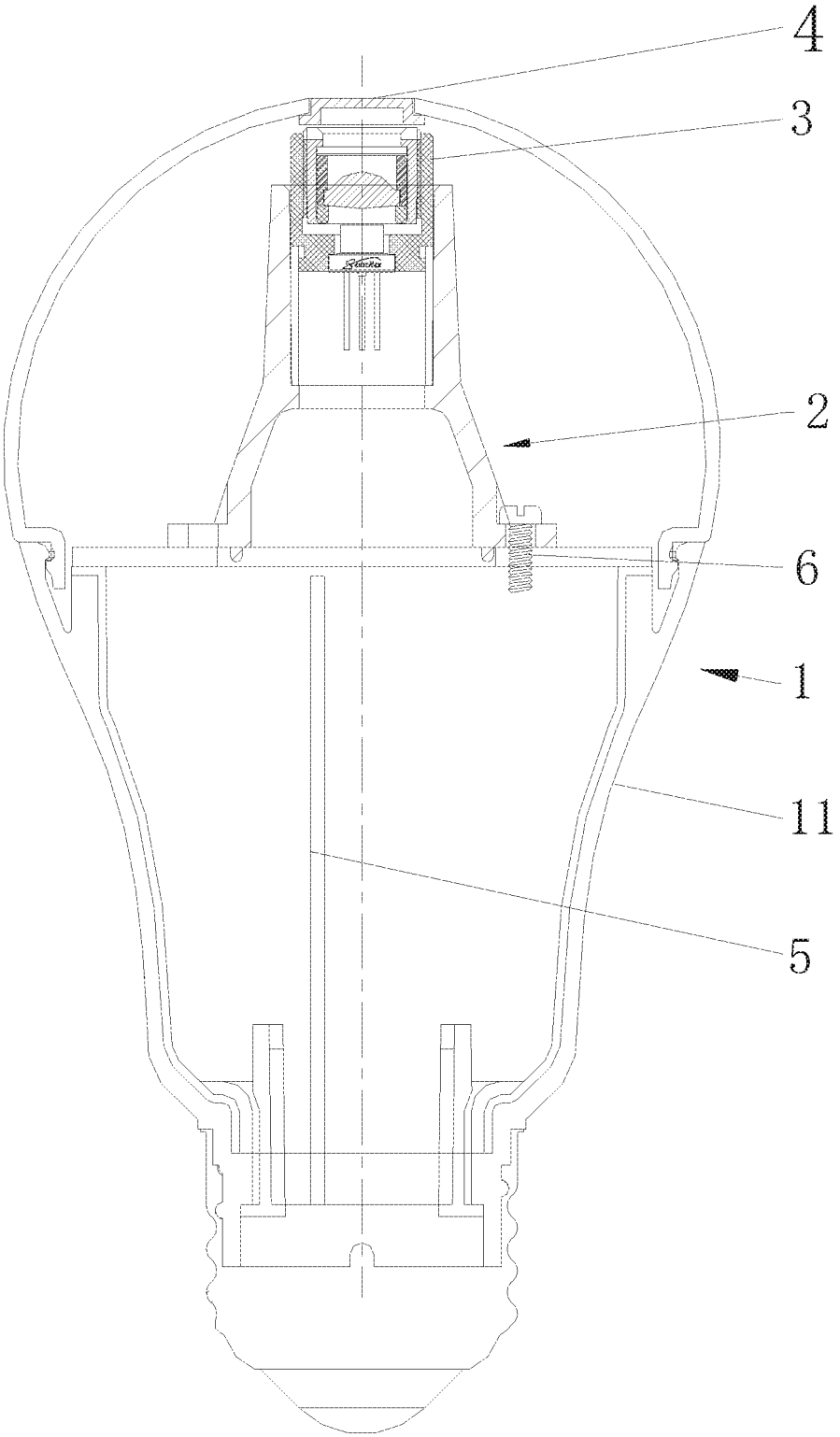
FIG. 1 is a cross-sectional view of a laser light installed inside a cavity of a bulb lamp according to the invention.

Reference numerals of main components are as follows. bulb lamp 1; lamp holder 11; LED light board 12; lamp cover 13; through hole 131; fixing support 2; small conical part 21; big conical part 22; support legs 23; ear shaped parts 24; screw hole 25; laser module 3; lens module 31; focus base 311; male threads 3111; transparent piece 312; grating piece 313; lens base 314; lens 315; lens fixing base 316;

fastener 3161; laser head base 32; female threads 321; laser head 33; heat dissipating tube 34; transparent cap 4; PCB board 5; screws 6.

DETAILED DESCRIPTION OF ILLUSTRATED EMBODIMENTS

The invention will be further explained below in detail with reference to figures.

Figure 2:
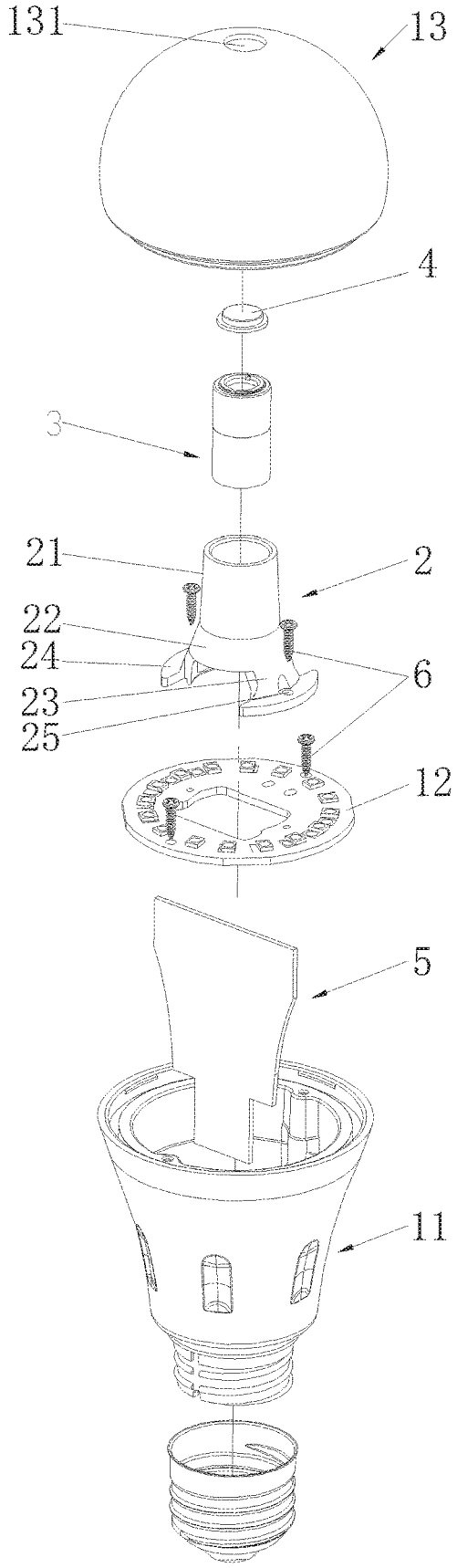
FIG. 2 is an exploded view of a laser light installed inside a cavity of a bulb lamp according to the invention.

Referring to FIGS. 1 and 2, the laser light installed inside a cavity of a bulb lamp comprises a bulb lamp 1, wherein an LED light board 12 is arranged inside the cavity of the bulb lamp 1, a fixing support 2 which further has heat dissipation function is coaxially arranged on the LED light board 12, a laser module 3 is sleeved inside the fixing support 2, and a lamp cover 13 is fastened to a lamp holder 11.

Referring to FIGS. 1 and 2, the fixing support 2 mainly consists of a small conical part 21, a big conical part 22 extending from a bottom of the small conical part 21, a pair of support legs 23 symmetrically extending from a bottom of the big conical part 22, ear shaped parts 24 respectively extending radially outwards from ends of support legs 23, and screw holes 25 respectively provided on the ear shaped parts 24.

Referring to FIGS. 1 and 2, the laser module 3 mainly consists of a lens module 31, a laser head base 32, a laser head 33, and a heat dissipating tube 34.

Figure 3:
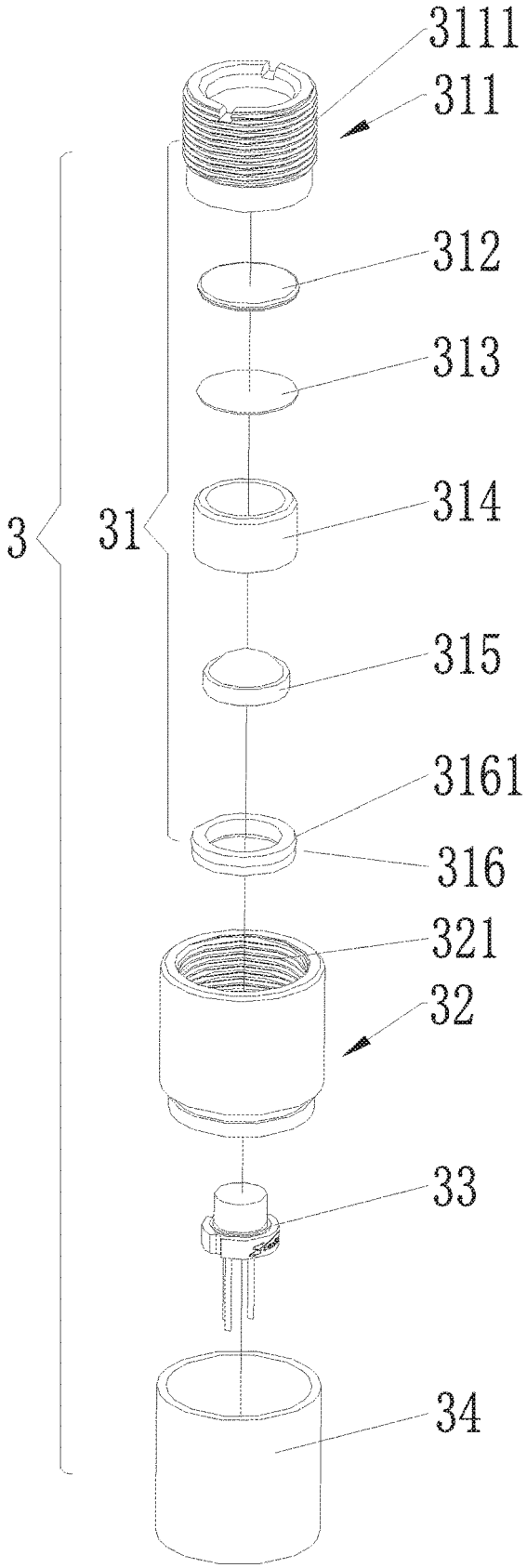
FIG. 3 is an exploded view of a laser module of a laser light installed inside a cavity of a bulb lamp according to the invention.

Referring to FIGS. 1, 2 and 3, the lens module 31 mainly consists of a focus base 311, a transparent piece 312, a grating piece 313, a lens base 314, a lens 315 and a lens fixing base 316 that are accommodated in the lens base 314, a fastener 3161 arranged on the lens fixing base 316, and male threads 3111 formed on the focus base 311. The transparent piece 312, the grating piece 313, and the lens base 314 are sleeved inside the focus base 311 in sequence. The laser head base 32 is formed with female threads 321. A through hole 131 is provided on a portion of the lamp cover 13 corresponding to the laser module 3. The through hole131 is enclosed by a transparent cap 4.

Referring to FIGS. 1, 2 and 3, a method of assembling a laser light inside a cavity of a bulb lamp comprises the following steps.

(1) Inserting a transparent piece 312, a grating piece 313, a lens base 314, a lens 315, a lens fixing base 316 in sequence into a focus base 311. Meanwhile, assembling these components in an integrated manner into a lens module 31 by means of a fastener 3161 of the lens fixing base 316.

(2) Inserting a laser head 33 into a laser head base 32, connecting the laser head base 32 with the lens module 31 in a threaded connection manner by engaging male threads 3111 of the focus base 311 with female threads 321 of the laser head base 32, and then engaging a heat dissipating tube 34 with a bottom of the laser head base 32, whereby a laser module 3 is assembled.

(3) Inserting the assembled laser module 3 into a fixing support 2, connecting the laser module 3 with a PCB board 5 by a wire, mounting the fixing support 2 at an opening of an LED light board 12, and guiding screws 6 through screw holes 25 of ear shaped parts of the fixing support 2 and screw holes of the LED light board 12 to fixedly connect the fixing support 2 with the LED light board 12.

(4) Ultrasonic fixing a transparent cap 4 with a lamp cover 13, and finally fastening the lamp cover 13 to a lamp holder 11 to complete the installation.

INDUSTRIAL APPLICABILITY

All the above are merely preferred embodiments of the invention. The invention is intended to cover all equivalent arrangements and modifications included within the scope of the invention.

The invention claimed is:

1. A laser light installed inside a cavity of a bulb lamp, comprising a bulb lamp, wherein a fixing support having heat dissipation function is coaxially arranged on an LED light board disposed inside the cavity of the bulb lamp, a laser module is sleeved inside the fixing support, a through hole is provided on a portion of a lamp cover corresponding to the laser module, and the through hole is enclosed by a transparent cap; wherein the laser module consists of a lens module, a laser head base, a heat dissipating tube, and a laser head disposed inside the laser head base, wherein the lens module consists of a focus base, and further, a transparent piece, a grating piece, a lens base, a lens and a lens fixing base accommodated in the lens base, which are sleeved inside the focus base in sequence.

2. The laser light installed inside a cavity of a bulb lamp according to claim 1, wherein the fixing support consists of a small conical part, a big conical part extending from a bottom of the small conical part, a pair of support legs symmetrically extending from a bottom of the big conical part, ear shaped parts respectively extending radially outwards from ends of support legs, and screw holes respectively provided on the ear shaped parts.

3. A method of assembling a laser light inside a cavity of a bulb lamp, comprising steps of:

(1) inserting a transparent piece, a grating piece, a lens base, a lens, a lens fixing base in sequence into a focus base, and meanwhile, assembling the focus base, the transparent piece, the grating piece, the lens base, the lens, and the lens fixing base in an integrated manner into a lens module by means of a fastener of the lens fixing base;

(2) inserting a laser head into a laser head base, connecting the laser head with the lens module in a threaded connection manner by engaging male threads of the focus base with female threads of the laser head base, and then engaging a heat dissipating tube with a bottom of the laser head base, whereby a laser module is assembled;

(3) inserting the assembled laser module into a fixing support, connecting the laser module with a PCB board by a wire, mounting the fixing support at an opening of an LED light board, and guiding screws through screw holes of ear shaped parts of the fixing support and screw holes of the LED light board to fixedly connect the fixing support with the LED light board;

(4) ultrasonic fixing a transparent cap with a lamp cover, and finally fastening the lamp cover to a lamp holder to complete the installation.

* * * * *